US006074221A

United States Patent [19]

Kajiwara

[11] Patent Number: 6,074,221

[45] Date of Patent: Jun. 13, 2000

[54] SOCKET FOR A DISPLAY PANEL

[75] Inventor: Yasushi Kajiwara, Kawaguchi, Japan

[73] Assignee: Enplas Corporation, Saitama, Japan

[21] Appl. No.: 09/315,779

[22] Filed: May 20, 1999

Related U.S. Application Data

[63] Continuation of application No. 08/943,048, Oct. 1, 1997.

[51] Int. Cl.[7] ..... H01R 9/09

[52] U.S. Cl. ..... 439/67; 439/495

[58] Field of Search ..... 439/66, 67, 495, 439/68, 70, 74

[56] References Cited

U.S. PATENT DOCUMENTS 4,630,874 12/1986 Ren et al. ..... 439/67
5,362,247 11/1994 Rodriguez ..... 439/66
5,376,008 12/1994 Rodriguez ..... 439/66
5,791,913 8/1998 Kajiwara ..... 439/67
5,839,917 11/1998 Takahashi ..... 439/495

*Primary Examiner*—Lincoln Donovan
*Assistant Examiner*—J. F. Duverne
*Attorney, Agent, or Firm*—Fish & Richardson P.C.

[57] ABSTRACT

Contact films 9 are provided on a socket body 6, and a pressing plate 11 can freely advance and retract so as to move outward from the upper surface of a substrate 1*a* of the display panel placed on the contact films 9. A clamp lever 14 is provided above the pressing plate. The pressing plate 11 is advanced to place the front end thereof on the substrate of the display panel, then the back surface of the pressing plate is pressed by the clamp lever 14.

6 Claims, 7 Drawing Sheets

SOCKET FOR A DISPLAY PANEL

This application is a continuation of Ser. No. 08/943,048 filed Oct. 1, 1997.

BACKGROUND OF THE INVENTION

1. Field of the Invention

The present invention relates to a display panel socket which can be preferably used for inspection of the display quality etc. of a liquid crystal display panel, electroluminescence panel, plasma display panel, etc.

2. Description of the Related Art

In general, in the manufacturing process of a liquid crystal display panel etc., the display panel is inspected for the display quality etc. for detecting display defects before connection of peripheral circuits such as driving IC tabs. Accordingly, in this type of inspection, a socket provided with contact members for contact with electrode terminals arranged on the substrate of the display panel has been used. For example, as shown in Japanese Unexamined Patent Publication (Kokai) No. 6-08034, as the contact members to be brought into contact with the electrode terminals of the display panel, conventionally, there have been known those constituted by needle-shaped or wire-shaped probes and contact films comprised of base films having a flexibility and insulation property on which contactors are formed. Along with a rise of density of electrode terminals and increasing fineness of the pitch, the trend is toward use of contact films from the viewpoints of the reliability of contact with the electrode terminals, facility of handling, manufacturing costs, etc.

When contact films are used, in order to bring the contactors on the contact films and the electrode terminals on the substrate of the display panel into contact under a required contact pressure, a film pressing member for pressing the back surface of the contact films and a panel pressing member for pressing the back surface of the substrate of the display panel become necessary. For example, Japanese Unexamined Patent Publication (Kokai) No. 8-233886 of the present assignee discloses a display panel socket provided with a film pressing member made of an elastomer such as rubber, a panel pressing member made of a metal having a substantially lateral U-shaped cross-section with a spring property, and a flexible shutter which moves from a retracted position for opening the area for mounting the display panel to a covered position for covering the top of the display panel and interposed between the panel pressing member and the display panel when moving from the retracted position at which the panel pressing member opens the area for mounting the display panel to the pressing position for pressing the upper surface of the display panel. This panel pressing member made of metal is slidably mounted on the socket body so as to vertically sandwich the socket body and is constituted so as to press the display panel to the contact films via the flexible shutter when moving to the upper surface of the display panel mounted on the contact films.

However, the panel pressing member made of metal having a substantially lateral U-shaped cross-section easily warps when it is formed by pressing or the like. Particularly, the upper piece of the panel pressing member is easily rippled or turned back along the direction of arrangement of the electrode terminals, therefore it becomes difficult to uniformly press the upper surface of the display panel. This becomes a cause of deterioration of the reliability of contact between the electrode terminals on the substrate of the display panel and the contactors on the contact films. Further, where both of the panel pressing member and the shutter are made of metal, metal abrasion powder is liable to be generated due to the sliding movement between the metals. This will adhere to the contactors on the contact films and become a cause of obstructing contact between the electrode terminals and the contactors.

SUMMARY OF THE INVENTION

Accordingly, an object of the present invention is to provide a display panel socket capable of improving the reliability of contact between electrode terminals on the substrate of the display panel and the contactors on the contact film.

In order to achieve the above object, the present invention provides a display panel socket for bringing a front end of a contact film into contact with electrode terminals arranged on a substrate of a display panel with a required contact pressure for electrically connecting the contact film with the display panel, the display panel socket characterized in that a pressing plate which can advance and retract between an advanced position where the pressing plate is located on the substrate of the display panel and a retracted position where the pressing plate is separated from the top of the substrate is provided on the socket body for supporting a base end portion of the contact film and in that a clamp lever for pressing the pressing plate from the top when the pressing plate is located at the advanced position is provided on the socket body.

According to the above configuration, by pressing the pressing plate by the clamp lever after the front end of the pressing plate is located on the substrate of the display panel, the substrate of the display panel and the contact film can be brought into contact with the required contact pressure. Namely, the pressing plate can be moved onto the substrate without causing a large frictional force, therefore occurrence of scratches on the substrate of the display panel, positional deviation of the display panel, etc. can be prevented.

Preferably, the base end portion of the clamp lever is pivotally attached to a pressing shaft which is parallel to the contact film and is provided above the pressing plate; and a pressing piece for pressing the pressing plate when pivoting from a position at which the front end portion of the pressing plate stand vertical to a position of a substantially horizontal posture is provided at the base end portion of the clamp lever.

According to the above configuration, when the clamp lever is pivoted from the standing position to the position of a substantially horizontal posture, the pressing plate is pressed by the pressing piece of the clamp lever and bring the substrate of the display panel into contact with the contact film under the required contact pressure, therefore the clamp lever do not get in the way in a state where the display panel is held at the socket body by the pressing plate. Accordingly, a display panel socket which is excellent in portability can be provided.

Further, in order to achieve the above object, according to the present invention, there is provided a display panel socket for bringing a front end portion of a contact film into contact with electrode terminals arranged on a substrate of a display panel under a required contact pressure for electrically connecting the contact film with the display panel, the display panel socket characterized in that a support plate extending adjacently to an edge of the substrate of the display panel placed on the contact film is provided on the socket body for supporting the contact film; a pressing shaft extending in parallel to the direction of arrangement of the electrode terminals of the display panel is provided above the support plates; a pressing plate capable of moving between an advanced position at which a front end portion of the pressing plate presses the upper surface of the substrate of the display panel and a retracted position at which the front end portion of the pressing plate rides up over the support plate is provided between the support plate and the pressing shaft; the pressing plate is engaged at a base end portion thereof with a front engagement groove provided at a rear portion of the support plate and, at the same time, an intermediate portion of the pressing plate is pressed by the pressing shaft at the advanced position and is engaged with a rear engagement groove provided at a rear portion of the support plate and thereby restricted in position at the retracted position.

In the display panel socket of the above configuration, by the advancing and retracting movement of the pressing plate provided on the upper side of the socket body, attachment and detachment of the substrate of the display panel and the connection and release of the substrate of the display panel and the contact film can be easily carried out, therefore the efficiency of work at the time of inspection of the display panel is improved. Further, also at the time of assembly of the socket, the pressing plate is attached to the upper side of the socket body, so the assembly work becomes easy in comparison with the configuration of related art and therefore the display panel socket can be cheaply provided.

When mounting the display panel in the socket, first it is confirmed that the pressing plate is located at the retracted position, then the display panel is mounted in the socket and the edge portion of the display panel is made to abut against the front end of the support plate, thereby positioning it for attachment. Thereafter, the rear end portion of the pressing plate is advanced up to the position where the pressing plate is engaged with the engagement groove of the front portion of the support plate and rides up over the substrate. By the simple operation described above, connection with a high precision is possible and inspection with a high reliability becomes possible.

Preferably, a flexible shutter is interposed between the substrate of the display panel and the front end portion of the pressing plate; the flexible shutters is provided with engagement tongue pieces engaged with engagement pieces provided on the base end portion of the pressing plate; and, when the pressing plate advances to the substrate, the flexible shutter first ride up over the substrate and guides the pressing plate, and, when the pressing plate is retracted from the substrate, the pressing plate is completely retracted from the top of the substrate and then the engagement tongue pieces are pulled back by the engagement pieces and thus the flexible shutter is retracted.

According to the above configuration, since, when the pressing plate advances, the flexible shutter first rides up over the substrate and guides the pressing plate coming later, and when the pressing plate retracts, the pressing plate is completely detached from the top of the substrate and then the flexible shutter starts the retracting movement, the frictional force of the pressing plate is prevented from being directly applied to the substrate of the display panel and abrasion can be reduced. Accordingly, a display panel socket with a good operability can be provided. Further, by preventing the positional deviation of the display panel and the contact film etc., more correct and stable inspection can be realized.

Further preferably, the support plate comprises a base plate provided with a guide portion extending in the advancing and retracting direction of the pressing plate and a slide block capable of advancing and retracting while guided by the guide portion of the base plate; front and rear engagement grooves are formed in the slide block; and the front end portion of the pressing plate is advanced or retracted by the advancing or retracting operation of the slide block.

According to the above configuration, by advancing and retracting the slide block, the pressing plate can be easily advanced and retracted.

Further preferably, an engagement piece engaging with the pressing shaft when the pressing plate moves from the retracted position to the advanced position is provided on the pressing plate.

According to the above configuration, contact failure etc. due to the positional deviation of the display panel and deviation of the pressing position can be prevented by preventing an excessive advance of the pressing plate.

DESCRIPTION OF THE PREFERRED EMBODIMENTS

Figure 1:
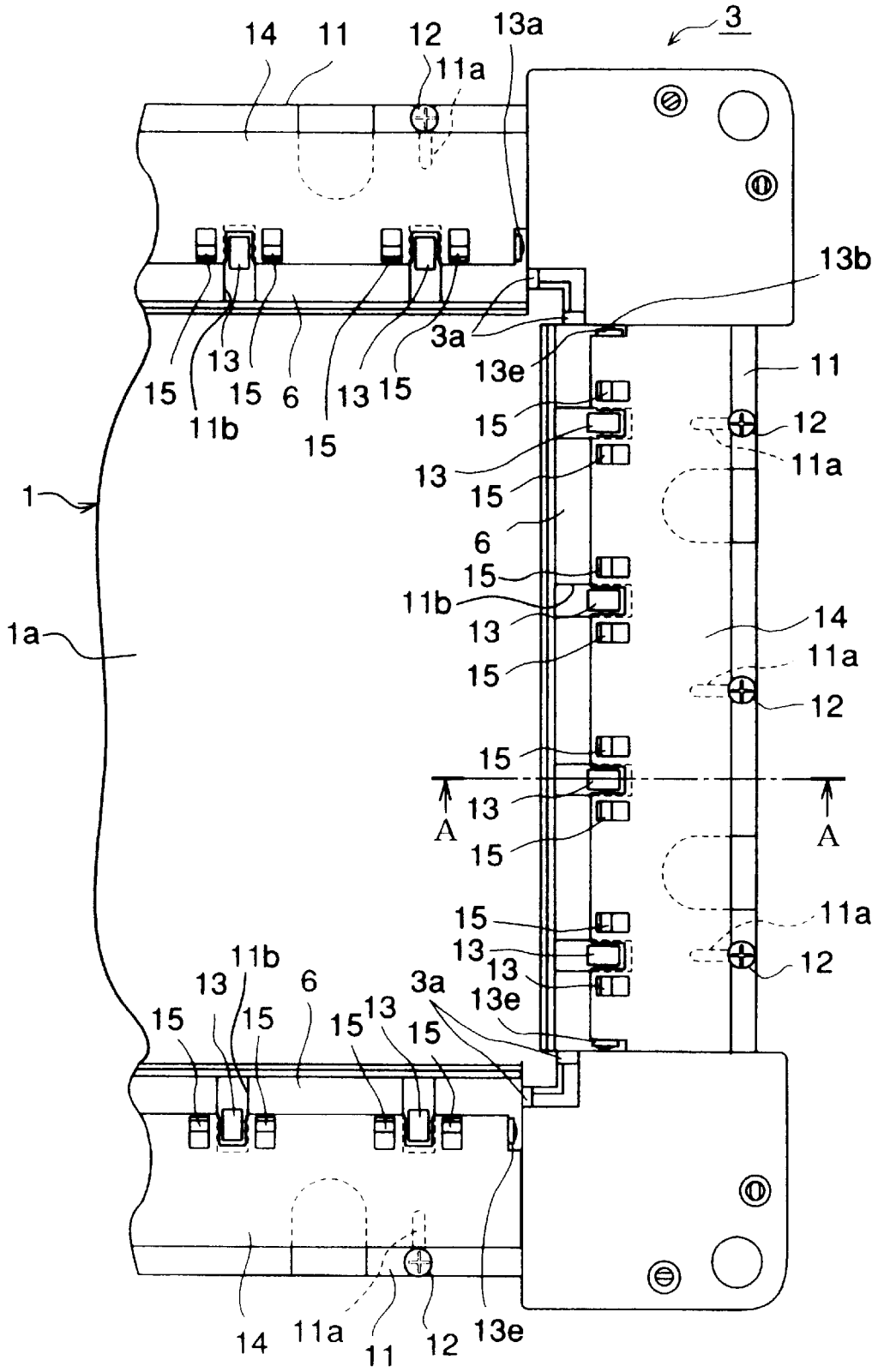
FIG. 1 is a plan view of principal parts in a state where a color liquid crystal display panel is inserted into and held at a display panel socket of the present invention.

Below, an explanation will be made of preferred embodiments of the present invention by referring to the drawings.

FIG. 1 is a plan view showing one side portion of a liquid crystal display panel socket according to a first embodiment of the present invention; and FIG. 2 to FIG. 5 are sectional views taken along a line A—A showing operation states of the socket.

Figure 15:
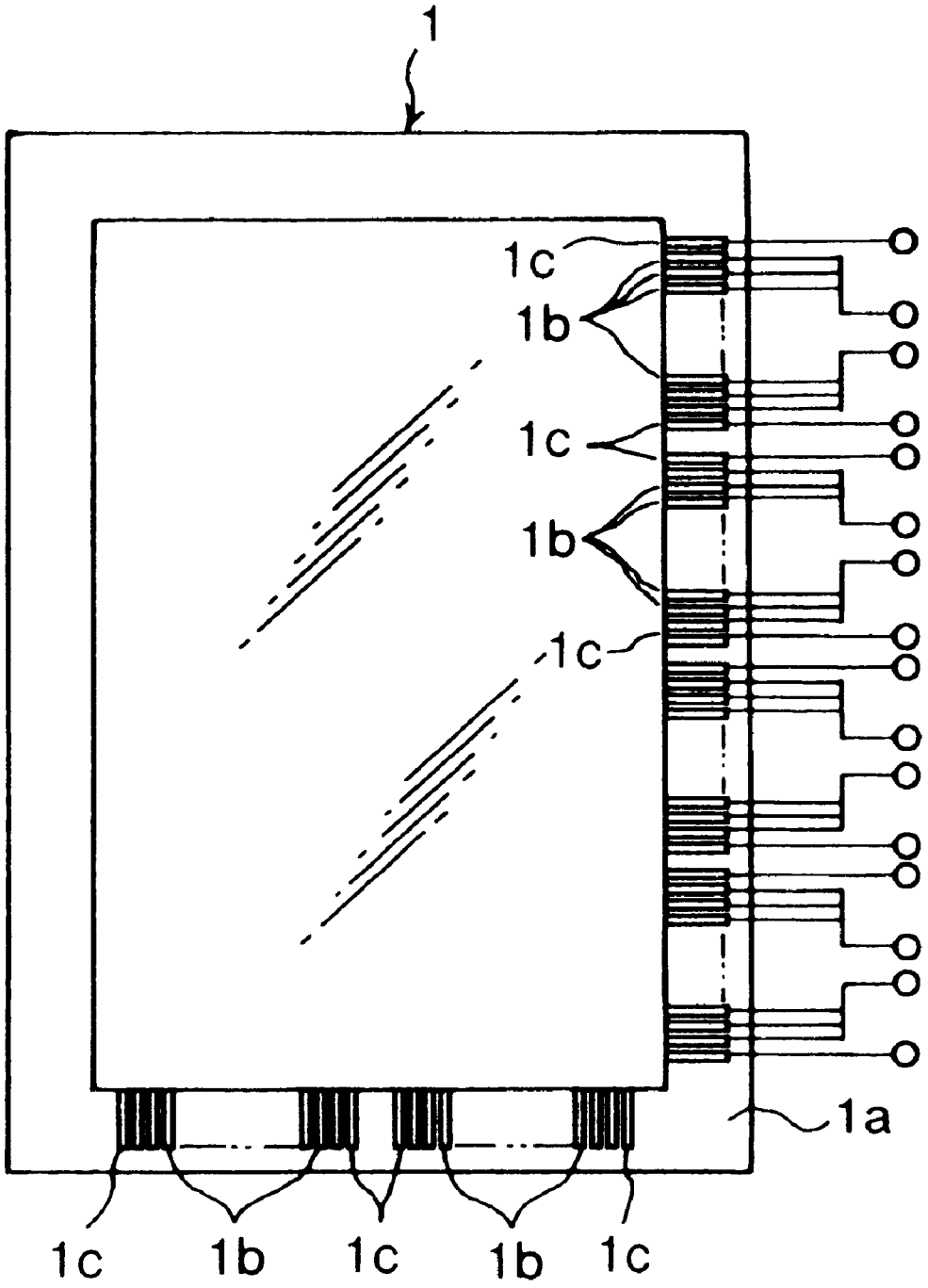
FIG. 15 is a plan view of a liquid crystal display panel.

Referring to FIG. 1 to FIG. 5, the socket is formed in a rectangular shape when seen from a plan view so as to be capable of mounting the color liquid crystal display panel 1. The color liquid crystal display panel 1 is, as shown in FIG. 15, comprised of a rectangular substrate 1*a* made of for example glass on which a rectangular liquid crystal display portion is formed. A plurality of electrode terminals 1*b* for use as pixel electrode terminals and electrode terminals 1*c* for use as common electrode terminals are arranged in parallel to each other on the substrate 1*a* along two side edges of the liquid crystal display portion. These electrode terminals 1*b* for use as pixel electrode terminals and electrode terminals 1*c* for use as common electrode terminals are divided into blocks corresponding to driving modules such as the tab ICs. A predetermined number of electrode terminals 1*b* for use as pixel electrode terminals corresponding to the different color pixels of the three colors (red, green, and blue) are alternately arranged in order for every block. At the same time, the electrode terminals 1*c* for use as common electrode terminals are formed on the outside of the area of arrangement of these electrode terminals 1*b* for use as pixel electrode terminals.

As shown in FIG. 1, the socket 3 is provided with reference engagement pieces 3*a* for engagement with corner portions of the substrate 1*a* of the color liquid crystal display panel 1 and substrate pressing means (not illustrated) arranged diagonally so as to press the substrate 1*a* of the color liquid crystal display panel 1 toward the reference engagement pieces 3*a*.

Figure 2:
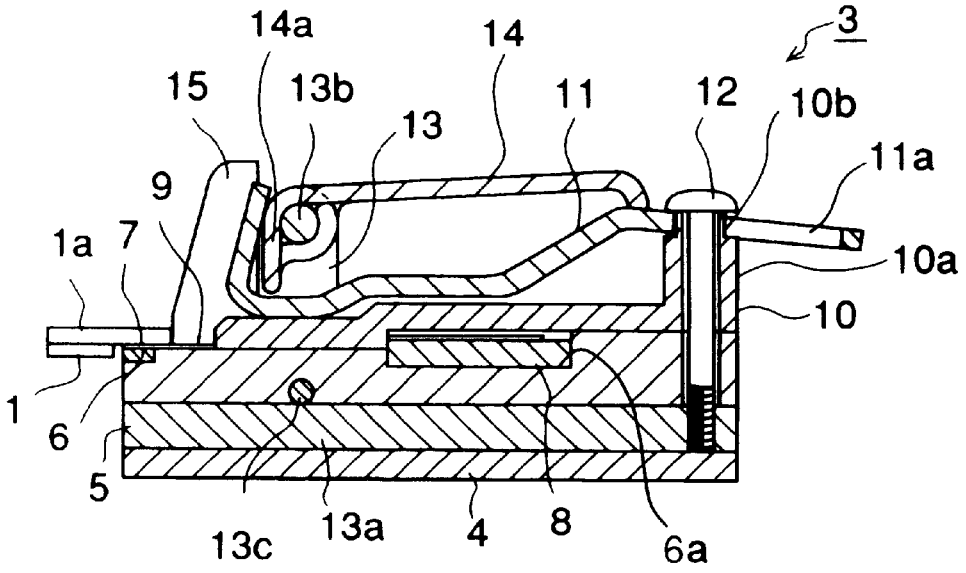
FIG. 2 is a view of the state of a socket in which a pressing plate is retracted in a sectional portion taken along a line A—A of FIG. 1.

The socket 3 is constituted as shown in the side sectional view of FIG. 2. A frame type base 5 is brought into contact in a superposed state with the top of a flat base 4 formed in a rectangular plate shape. Further, a socket body 6 is superposed on and joined to the upper portion of the frame type base 5. Recessed portions are formed in the upper surface of the front end of the socket body 6 along the edge portions, base portions of the film pressing members 7 formed by for example a rubber or urethane foam are formed there, and the upper end portions thereof are projected upward.

Further, corresponding to the side edge portions of the substrate 1*a* of the color liquid crystal display panel 1 on which electrode terminals are formed, recessed grooves 6 extending in parallel to the edges of the substrate 1*a*, that is, parallel to the direction of arrangement of the electrode terminals 1*b* and 1*c* of the color liquid crystal display panel 1, are formed in the upper surface of middle portion of the socket body 6. In each recessed groove 6, a film attachment board 8 preferably made of a material having substantially the same coefficient of linear expansion as that of the substrate 1*a*, for example, a glass epoxy resin, is received so that sliding displacement is possible in its longitudinal direction.

The rear end portions of a plurality of flexible contact films 9 provided with contactors, explained later, are attached to the upper surfaces of the film attachment boards 8 on the front end portions. The flexible contact films 9 can be formed by various plastics, but where the inspection use socket 3 is used for inspection of aging etc. of the color liquid crystal display panel 1, the flexible contact films 9 are preferably formed by a plastic able to withstand an ambient temperature of 80 to 100° C., for example, a polyimide. The front end portions of the flexible contact films 9 are located above the film pressing members 7.

Further, the support plates 10 are mounted superposed on the upper side of the socket body 6. Bolt insertion use walls or sleeves 10*a* are vertically placed at the rear end portions of the support plates 10. At the upper end portions of the sleeves 10*a* are formed smaller diameter step portions 10*b* which are inserted into slide use elongated holes 11*a* formed at rear ends of the pressing plates 11 mentioned later for holding the rear ends of the pressing plates 11 at predetermined height. Furthers, screws 12 which have front ends which pass through the socket body 6 and which are screwed into the frame type base 5 are inserted into the sleeves 10*a*. The top portions thereof are constituted so as to hold the rear ends of the pressing plates 11.

Further, between the film pressing members 7 of the socket body 6 and the film attachment boards 8, pressing shaft blocks 13 are provided which engage with the frame type base 5 at their bottom engagement portions 13*a* and act as columnar support members vertically passing through the socket body 6. In the upper end portions of the pressing shaft blocks 13 which extend upward after passing through the support plates 10, pressing shafts 13*b* which project in parallel to the edge portions of the substrate 1*a* of the color liquid crystal display panel 1 and in a horizontal direction are formed. The pressing shaft blocks 13 are reliably affixed to the socket body 6 by fixing shafts 13*c* passing through them in the horizontal direction. The two end portions of the fixing shafts 13*c* are prevented from being removed by E rings 13*e* as shown in FIG. 1.

Elongated holes 11*b* into which the pressing shaft blocks 13 are inserted are formed in the front ends of the pressing plates 11 extending to the pressing shaft block 13 side. It is also possible to configure the elongated holes as recessed portions having open front ends. At the position where the pressing plates 11 are most advanced, the front ends riding up over the edge portions of the substrate 1*a* of the color liquid crystal display panel 1 are bent slightly downward in a bulging state. The front most ends are bent extending upward.

Note that, the pressing plates 11 are formed by press-forming a metal plate having a spring property. Further, the desired performance can be secured even if the pressing plates 11 are molded from a plastic so long as the required rigidity is secured.

Further, clamp levers 14 for pressing the pressing plates 11 are pivotally affixed to the pressing shafts 13A. Pressing pieces 14*a* are provided at the operating points of the clamp lever 14, that is, the base end portions. The pressing pieces 14*a* press downward the middle portions of the pressing plates 11 located at the advanced position when pivoting the front end portions of the clamp levers 14 from the positions where they stand vertical with respect to the pressing plates 11 to the closed positions where they are substantially horizontal in posture.

Further, guide blocks 15 for guiding the mounting operation of the edge portions of the substrate 1*a* of the color liquid crystal display panel 1 are affixed to the front end portions of the support plates 10. The guide blocks 15 extend upward and are inclined so that the upper sides flare outward. They are formed so as to guide the edge portions of the substrate 1*a* to be mounted.

When mounting the color liquid crystal display panel 1 on the socket 3 configured as described above, first, as shown in FIG. 2, it is confirmed that the pressing plates 11 are in a state retracted to the furthest portions, then the substrate 1*a* of the color liquid crystal display panel 1 is inserted along the guide blocks 15.

Figure 3:
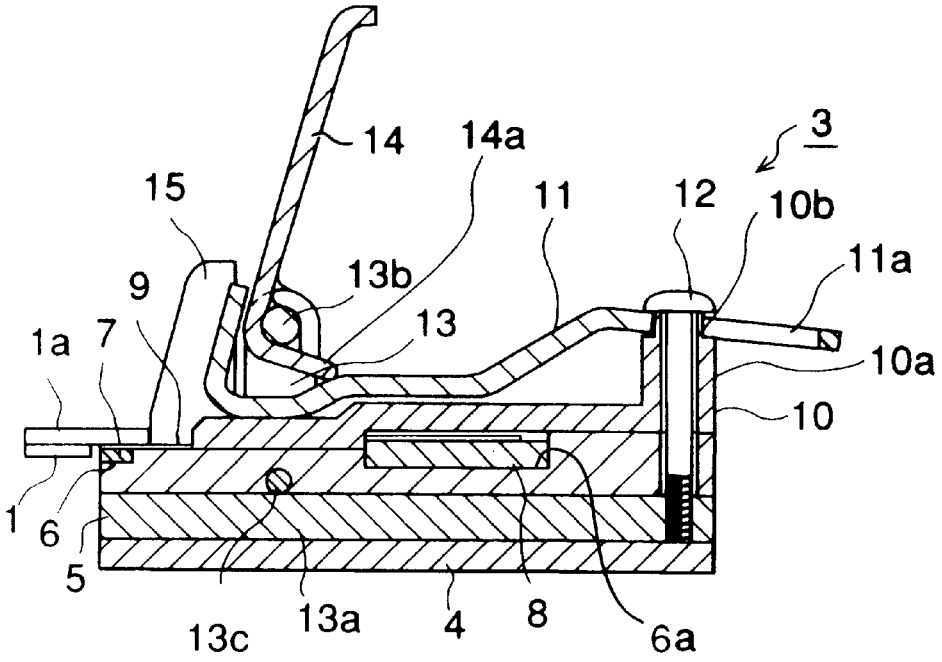
FIG. 3 is a view of the state of a socket in which a clamp lever of FIG. 2 is opened in the sectional portion taken along the line A—A of FIG. 1.
Figure 4:
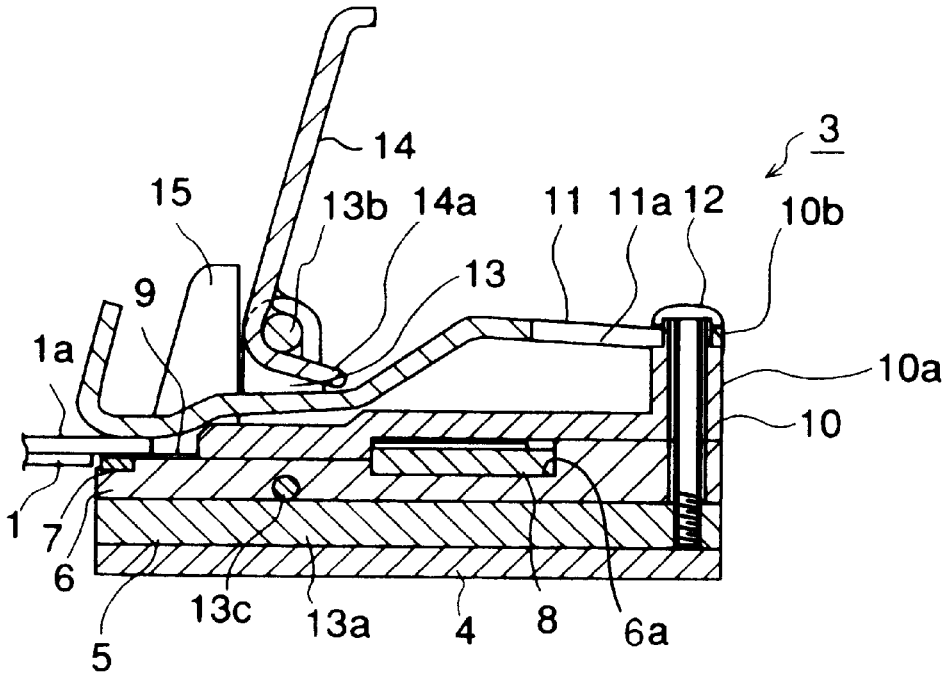
FIG. 4 is a view of the state of a socket in which the pressing plate of FIG. 3 is advanced in the sectional portion taken along the line A—A of FIG. 1.

In a state where the substrate 1*a* of the color liquid crystal display panel 1 is in contact with the top of the flexible contact films 9 on the film pressing members 7, the clamp levers 14 are opened as shown in FIG. 3 to release the pressing plates 11. Next, as shown in FIG. 4, the pressing plates 11 are advanced and the front end portions of the pressing plates 11 are moved onto the substrate 1*a* of the color liquid crystal display panel 1. In this state, the substrate 1*a* is in contact with the flexible contact films 9. The contact portions are located so that the flexible contact films 9 abut against the film pressing members 7 and so that the substrate 1*a* corresponding to this abuts against the front end portions of the pressing plates 11.

Figure 5:
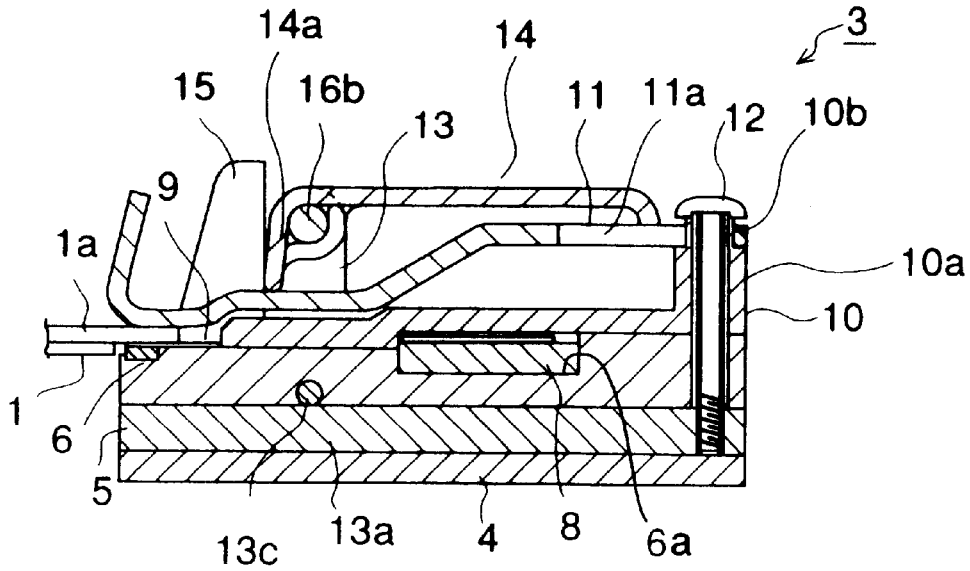
FIG. 5 is a sectional view of a socket to which a display panel is attached taken along the line A—A.

Then, as shown in FIG. 5, by closing the clamp levers 14, the pressing pieces 14*a* press the middle portions of the pressing plates 11 downward. In such a clamped state, the substrate 1*a* and the flexible contact films 9 sandwiched by the pressing plates 11 and the film pressing members 7 having elasticity are brought into close contact with each other without irregularity, therefore an extremely high precision of terminal connection can be realized.

Further, as shown in FIG. 5, when detaching the color liquid crystal display panel 1 from the socket 3, an operation reverse to the mounting procedure may be carried out. By opening the clamp levers 14 as shown in FIG. 4 and retracting the pressing plates 11 as shown in FIG. 3, the color liquid crystal display panel 1 can be detached. Further, it is also possible to close the clamp levers 14 as shown in FIG. 2 in this state.

Note that, it is also possible to provide operation knobs etc. for improving the operability of the pressing plates 11 and the clamp levers 14.

Next, an explanation will be made of a second embodiment of the present invention.

FIG. 6 to FIG. 11 show a display panel socket according to the second embodiment of the present invention. This socket 25 is for inspecting the liquid crystal display panel 1 shown in FIG. 15 and simultaneously supplies signals for inspecting the display quality etc. to all electrode terminals 1*b* and 1*c* on the source side and gate side of the liquid crystal display panel 1.

Figure 6:
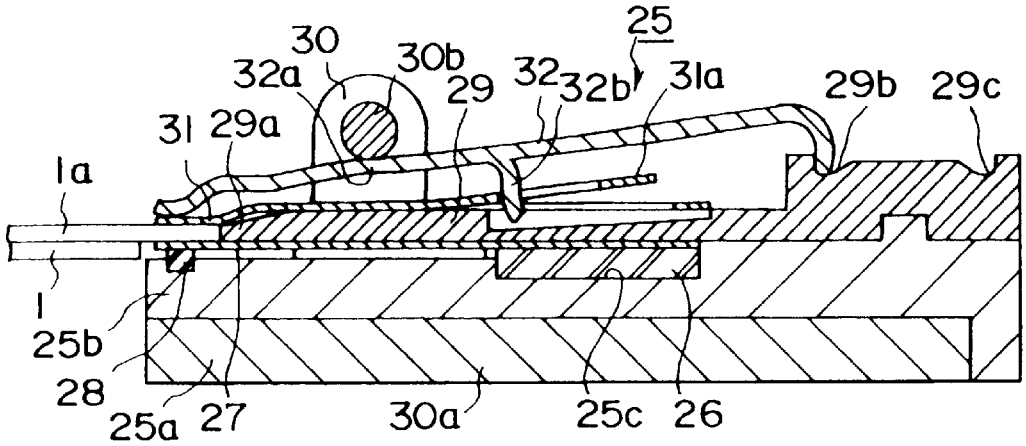
FIG. 6 is a side sectional view of a display panel socket in which the pressing plate is advanced.

Referring to FIG. 6, a socket body 25*b* is engaged with and attached to the upper portion of the frame type base 25*a* of the socket 25 corresponding to the edge portions of the liquid crystal display panel 1 to constitute the socket body. Recessed grooves 25*c* extending in parallel to the side edges of the insulating substrate 1*a* are formed in the upper surface of the socket body 25*b* corresponding to the side edge portions of the insulating substrate 1*a* of the liquid crystal display panel 1 on which the electrode terminals 1*b* and 1*c* are formed. Film attachment boards 26 made of an insulating material having almost the same coefficient of linear expansion as that of the insulating substrate 1*a*, for example, the same material as that of the insulating substrate 1*a*, are accommodated in the recessed grooves 25*c* so that they can slidingly displace in the longitudinal direction thereof. A plurality of contact films 27 are fixed to the upper surfaces of the film attachment boards 26 by for example an adhesive. Contactors (illustration is omitted) to be brought into contact with the electrode terminals 1*b* and 1*c* of the liquid crystal display panel 1 (refer to FIG. 15) are formed on the upper surfaces of the contact films 27.

Further, the socket body 25*b* is provided with film pressing members 28 for pressing the lower surfaces of the front end portions of the contact films 27. The film pressing members 28 are formed by an elastomer such as rubber. The base portions are inserted in the socket body 25*b* in the fitted state.

Further, support plates 29 provided with a limiting end portions 29*a* for defining the insertion position of the liquid crystal display panel 1 are provided on the upper side of the socket body 25*b*.

Between the film pressing members 28 and the recessed grooves 25*c* are mounted pressing shaft blocks 30 which have bottom engagement portions 30*a* which engage with the frame type base 25*a* and which project upward while passing through the socket body 25*b* and the support plates 29. The pressing shaft blocks 30 are provided with pressing shafts 30*b* projecting upward and projecting in the horizontal direction.

Flexible shutters 31 comprised of sheets made of plastic are mounted on the upper portions of the front ends of the support plates 29. Further, pressing plates 32 are mounted on the upper sides of the flexible shutters 31. The pressing plates 32 are manufactured by press-forming metal plates having a spring property. Cutaways are formed at the front ends splitting the ends into two. The pressing shaft blocks 30 are inserted into the split portions, and the pressing shafts 30*b* are engaged from above. The front end portions of the pressing plates 32 are configured bent to loose S-shapes and press the insulating substrate 1*a* at the curved surfaces. The rear end portions are formed bent downward and engage with either of the front and rear engagement grooves 29*b* and 29*c* formed in the rear portions of the support plates 29. Further, projecting portions 32*a* which project upward and abut against the pressing shaft 30*b* so that, in the state where the front end portions of the pressing plates 32 abut against the insulating substrate 1*a* of the liquid crystal display panel 1, they make the front end portions more effectively abut against the insulating substrate 1*a* are formed at the middle portions corresponding to the pressing shafts 30*b*. Further, engagement pieces 32*b* which are bent downward and engage with engagement tongue pieces 31*a* formed by cutting and raising parts of the flexible shutters 31 are provided at the rear sides of the projecting portions 32*a* of the pressing plates 32.

The pressing plates 32 are configured so as to sandwich the insulating substrate 1*a* of the liquid crystal display panel 1 so as to press it against the contact films 27 as shown in FIG. 6. At this time, the film pressing members 28 are interposed between the socket body 25*b* and the contact films 27 with elasticity, and the flexible shutters 31 are interposed between the pressing plates 32 and the insulating substrate 1*a*.

Figure 7:
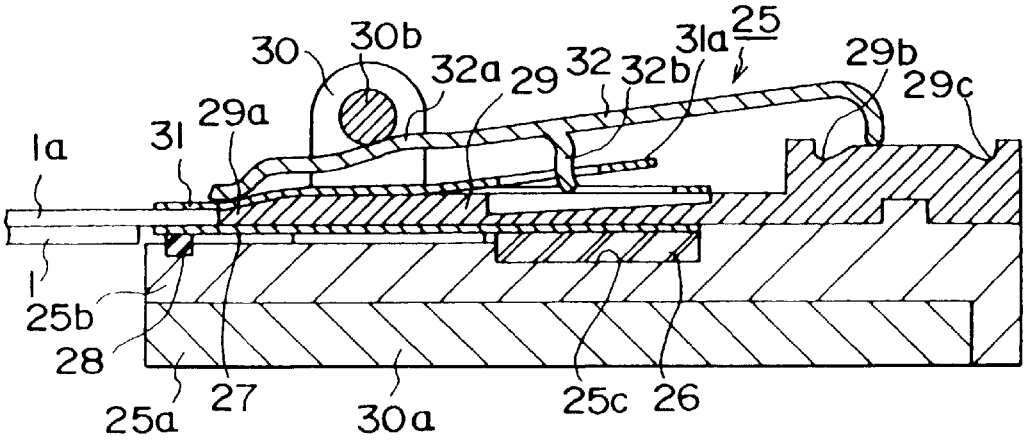
FIG. 7 is a side sectional view of a display panel socket during the retraction of the pressing plate
Figure 8:
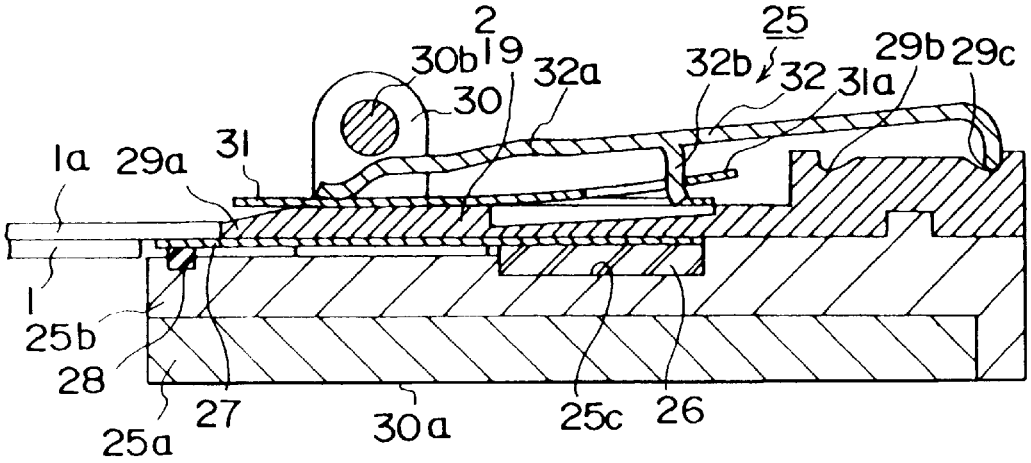
FIG. 8 is a side sectional view of a display panel socket in which the pressing plate is retracted.

As shown in FIG. 7, by retracting the pressing plates 32 so as to detach the rear end portions of the pressing plates 32 from the engagement grooves 29*b* of the front of the support plates 29, the projecting portions 32*a* of the pressing plates 32 are ridden over and the pressing force to the insulating substrate 1*a* side is reduced. By further retracting the pressing plates 32 while maintaining this state, as shown in FIG. 8, the engagement pieces 32*b* engage with the engagement tongue pieces 31*a* and cause the flexible shutter 31 to retract. At this time, in a state where the front end portions of the pressing plates 32 press the insulating substrate 1*a*, the flexible shutters 31 do not move. After being retracted to the positions where the front ends of the pressing plates 32 detach from the insulating substrate 1*a*, the engagement pieces 32*b* engage with the engagement tongue pieces 31*a* and retract. The rear end portions of the pressing plates 32 finished being retracted engage with the engagement grooves 29*c* at the rear side.

Note that the pressing plates 32 are formed by metal plates having a spring property etc. to secure the required elasticity, but they are not limited to only this. It is also possible to elastically bias the pressing plates 32 downward by interposing coil springs on the pressing shaft 30*b* side for holding the pressing substrate 32 and constituting the pressing shafts 30*b* per se by plate springs or the like. It is also possible to adopt a configuration in which the front end portions of the pressing plates 32 are elastically biased to the contact film 27 side by interposing coil springs etc. in the part of the engagement grooves 29*b* and 29*c* before and after the support plates 29.

Further, although not provided in the above embodiment, by providing operation handles projecting upward, the operability of the pressing plates 32 can be further improved.

Figure 9:
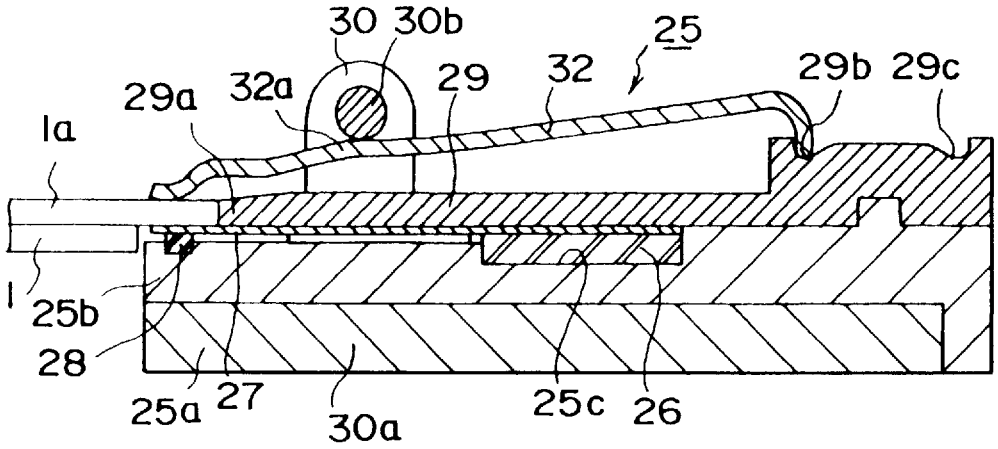
FIG. 9 is a side sectional view of a socket without a flexible shutter corresponding to FIG. 6.
Figure 10:
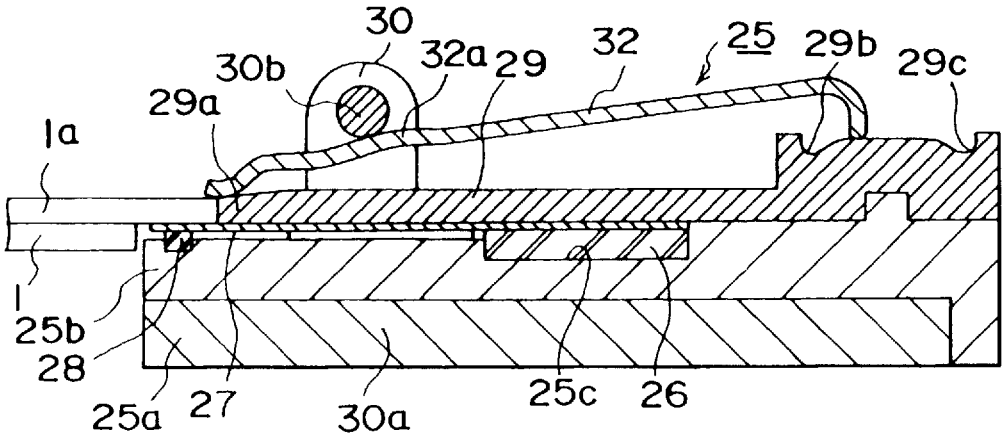
FIG. 10 is a side sectional view of a socket without a flexible shutter corresponding to FIG. 7.
Figure 11:
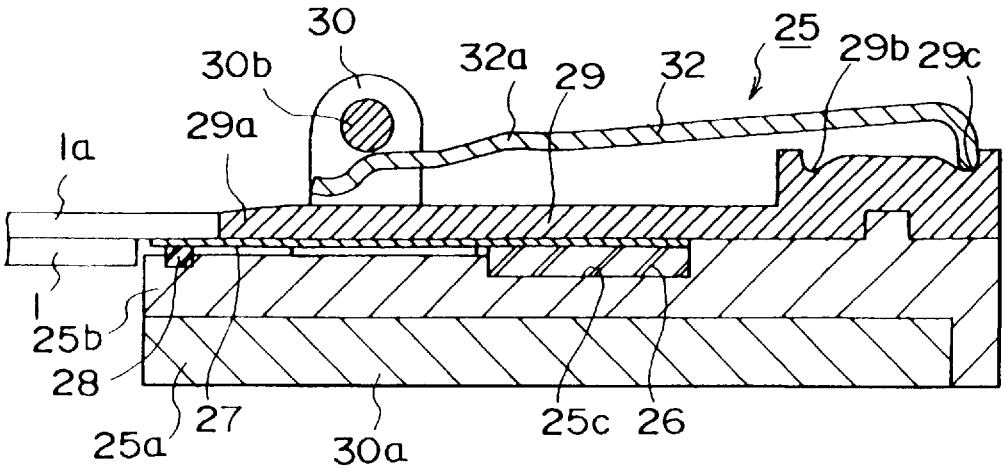
FIG. 11 is a side sectional view of a socket without a flexible shutter corresponding to FIG. 8.

Further, as shown in FIG. 9, FIG. 10, and FIG. 11, even if the flexible shutters 31 are not provided, it is possible to perform correct connection and the basically required performance will not be impaired.

Next, an explanation will be made of a third embodiment of the present invention.

Figure 12:
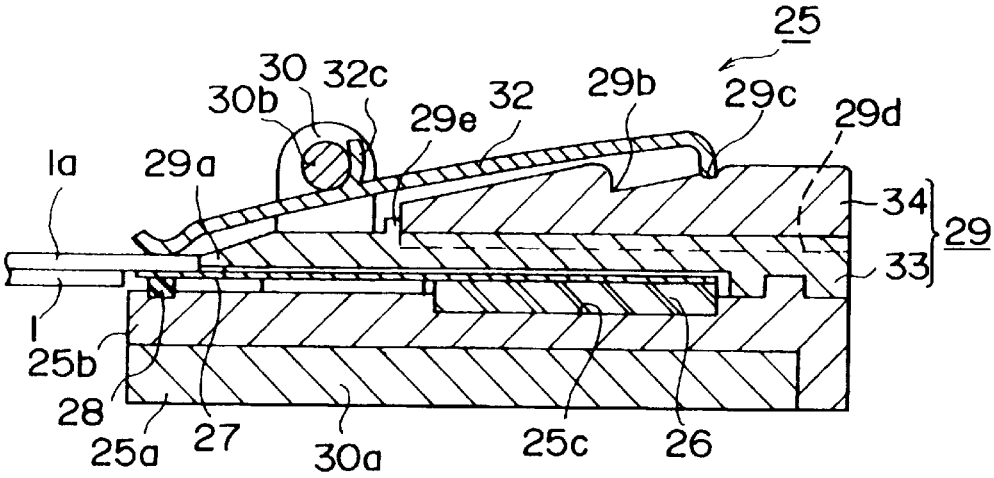
FIG. 12 is a side sectional view of a socket provided with a slide block.
Figure 13:
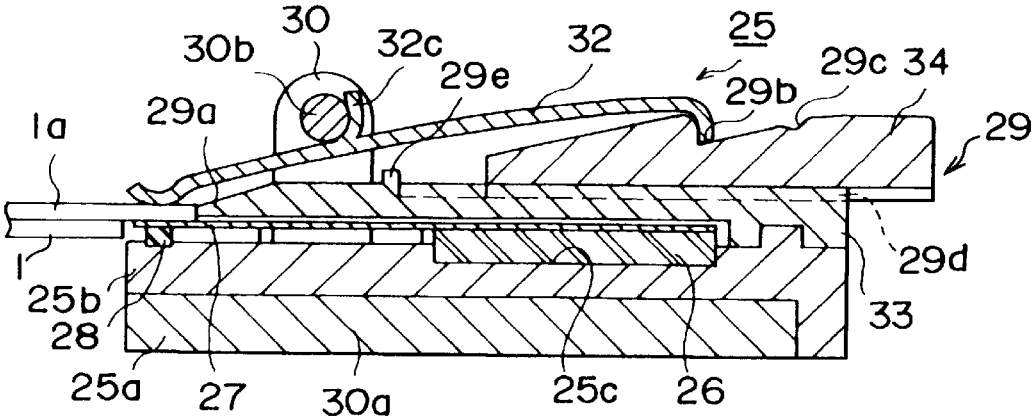
FIG. 13 is a side sectional view of a socket showing the state during the retraction of the slide block of FIG. 12.
Figure 14:
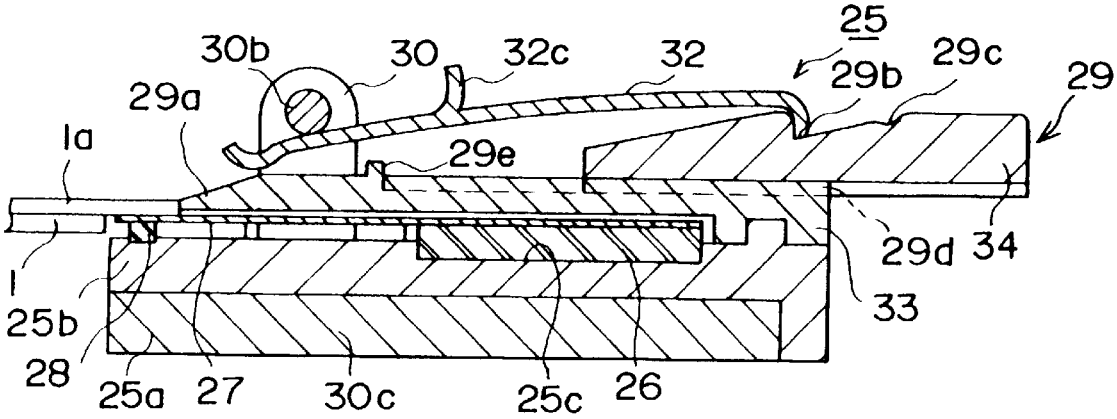
FIG. 14 is a side sectional view of a socket showing the state in that the slide block of FIG. 12 has been retracted.

FIG. 12 to FIG. 14 show a socket according to the third embodiment of the present invention. Referring to these figures, the socket 25 shown in FIG. 12 is constituted by fitting and attaching a socket body 25*b* to the upper portion of the frame type base 25*a* corresponding to the edge portions of the liquid crystal display panel 1. Recessed grooves 25*c* extending in parallel to the side edges of the insulating substrate 1*a* are formed in the upper surface of the socket body 25*b* corresponding to the side edge portions of the insulating substrate 1*a* of the liquid crystal display panel 1 on which electrode terminals are formed. Film attachment boards 26 made of for example the same material as that of the insulating substrate 1*a* are accommodated in the recessed grooves 25*c*. A plurality of contact films 27 are affixed to the upper surfaces of the film attachment boards 26.

The socket body 25*b* is provided with film pressing members 28 for elastically pressing the front end portions of the contact films 27 against the insulating substrate 1*a* of the liquid crystal display panel 1. The film pressing members 28 are formed by an elastomer such as rubber or urethane foam and are embedded in the socket body 25*b* in the fitted state.

Support plates 29 which have limiting end portions 29*a* which abut against the edge portions of the liquid crystal display panel 1 and define the insertion position thereof are provided at the upper side of the socket body 25*b*.

Further, through holes passing through the thickness direction are made in the portions of the socket body 25*b* located between the film pressing members 28 and recessed grooves 25*c*. The upper portions of the pressing shaft blocks 30 which have bottom engagement portions 30*a* which engage with the frame type base 25*a* pass through the frame type base 25*a* and project upward. Pressing shafts 30*b* projected in the horizontal direction are provided in the upper portions of the pressing shaft blocks 30.

Pressing plates 32 comprised of metal plates having a spring property which are press-formed or plastic molded articles having an appropriate elasticity are provided at upper sides of the support plates 29. The front end portions of the pressing plates 32 have front notches or elongated holes for allowing passage of the pressing shaft blocks 30. The pressing plates 32 are formed so that the front end portions are curved in the form of downward arcs and can ride up over the insulating substrate 1*a* of the liquid crystal display panel 1 without resistance.

Further, the middle portions are curved upward drawing a gentle arc. The engagement pieces 32*c* engaged with the pressing shafts 30*b* stand vertical at the position most advanced to the liquid crystal display panel 1 side. The support plates 29 comprise base plates 33 and slide blocks 34 provided so as to freely advance and retract on the rear end thereof. The rear end portions of the pressing plates 32 are bent downward and engage with the rear engagement grooves 29*c* formed in the slide blocks 34. The slide blocks 34 are mounted so that they can freely advance and retract along the guide portions 29*d* formed at the rear of the upper surfaces of the base plates 33. The rear end portions are made to abut against the limiting walls 29*e* formed on the base plates 33 so as to be prevented from advancing over the required amount.

The socket 25 having the liquid crystal display panel 1 connected to it in FIG. 12 is in the position where the slide blocks 34 are most advanced. In this state, the rear end portions of the pressing plates 32 are engaged with the rear engagement grooves 29*c* between the front and rear engagement grooves 29*b* and 29*c* formed in the upper surfaces of the slide blocks 34, and the insulating substrate 1*a* of the liquid crystal display panel 1 is completely held. At this time, the insulating substrate 1*a* is pressed against and joined with the contact films 27 by the front end portions of the pressing plates 32 and the film pressing members 28. Further, the rear engagement grooves 29*c* of the slide blocks are set at a higher position than the front engagement grooves 29*b*, therefore the pressing plates 32 are pressed stronger in the pressed and joined state.

When releasing the connection with the contact films 27 and detaching the liquid crystal display panel 1, as shown in FIG. 13, the slide blocks 34 are retracted and the rear end portions of the pressing plates 32 engage with the engagement grooves 29*b* on the front sides of the slide blocks 33 and retract. The front end parts of the pressing plates 32 retracted as shown in FIG. 14 are retracted along the inclined front end portions of the base plates 33 and can release the pressing of the insulating substrate 1*a* of the liquid crystal display panel 1.

Note that it is possible to provide the socket 25 in this third embodiment with lubricant sheets for guiding purposes such as the flexible shutters 31 explained in the above second embodiment. Further, it is also possible to improve the advancing and retracting operation by providing handles for operation on the slide blocks 34.

As clear from the above explanation, according to the present invention, a display panel socket capable of improving the reliability of contact between electrode terminals on the substrate of the display panel and the contactors on the contact films can be provided.

What is claimed is:

1. A display panel socket for bringing a front end of a contact film into contact with electrode terminals arranged on a substrate of a display panel with a required contact pressure for electrically connecting the contact film with the display panel, the display panel socket characterized in that a socket body supporting thereon a base end portion of the contact films is provided with a pressing plate which can advance and retract between an advanced position where the pressing plate is located on the substrate of the display panel and a retracted position where the pressing plate is separated from the top of the substrate, and in that a clamp lever for pressing the pressing plate from the top when the pressing plate is located at the advanced position is provided on the socket body.

2. The display panel socket according to claim 1, characterized in that the clamp lever is pivotally attached at a base end portion thereof to a pressing shaft provided above the pressing plate and parallel to the contact film; and the clamp lever is provided at a base end thereof with a pressing piece for pressing the pressing plate when pivoting from a position at which the front end portion of the pressing plate stands vertical to a position of a substantially horizontal posture.

3. A display panel socket for bringing a front end portion of a contact film into contact with electrode terminals arranged on a substrate of a display panel under a required contact pressure for electrically connecting the contact film with the display panel, the display panel socket characterized in that a socket body for supporting thereon the contact film is provided with a support plate extending adjacently to an edge of a substrate of the display panel placed on the contact film; a pressing shaft extending in parallel to the direction of arrangement of the electrode terminals of the display panel is provided above the support plate; and a pressing plate capable of moving between an advanced position at which a front end portion of the pressing plate presses an upper surface of the substrate of the display panel and a retracted position at which the front end portion of the pressing plate rides up over the support plate is provided between the support plate and the pressing shaft, the pressing plates being engaged at a base end portion thereof with a front engagement groove provided at a rear portion of the support plate, while, at the same time, an intermediate portion of the pressing plate being pressed by the pressing shaft at the advanced position and being engaged with a rear engagement groove provided at rear portion of the support plate and thereby restricted in position at the retracted position.

4. The display panel socket according to claim 3, characterized in that a flexible shutter is interposed between the substrate of the display panel and the front end portion of the pressing plate, the flexible shutter being provided with engagement tongue pieces engaged with engagement pieces provided on the base end portion of the pressing plate and being formed in such a manner that, when the pressing plate advances to the substrate, the flexible shutter first rides up over the substrate and then guides the pressing plate, and, when the pressing plate is retracted from the substrate, the pressing plate is completely retracted from the top of the substrate and then the engagement tongue pieces are pulled back by the engagement pieces and the flexible shutter is retracted.

5. The display panel socket according to claim 3 or 4, characterized in that the support plate comprises a base plate provided with a guide rail extending in the advancing and retracting direction of the pressing plate and a slide block capable of advancing and retracting while guided by the guide rail of the base plate, the slide block being formed with front and rear engagement grooves, the front end portion of the pressing plate being advanced or retracted by the advancing or retracting operation of the slide block.

6. The display panel socket according to claim 5, characterized in that the pressing plate has an engagement piece engaging with the pressing shaft when the pressing plate moves from the retracted position to the advanced position.

* * * * *